US012552564B2

(12) United States Patent
Concetti et al.

(10) Patent No.: US 12,552,564 B2
(45) Date of Patent: Feb. 17, 2026

(54) METHOD AND APPARATUS FOR FILLING BAGS WITH A QUANTITY OF DEAERATED PRODUCT BY MEANS OF A DEAERATOR INSERTED IN THE PRODUCT

(71) Applicant: CONCETTI S.P.A., Bastia (IT)

(72) Inventors: Teodoro Concetti, Bastia (IT); Emanuele Concetti, Bastia (IT); Gianni Ceccacci, Bastia (IT)

(73) Assignee: CONCETTI S.P.A., Bastia (IT)

( * ) Notice: Subject to any disclaimer, the term of this patent is extended or adjusted under 35 U.S.C. 154(b) by 35 days.

(21) Appl. No.: 18/289,400

(22) PCT Filed: May 6, 2022

(86) PCT No.: PCT/IB2022/054203

§ 371 (c)(1),
(2) Date: Nov. 3, 2023

(87) PCT Pub. No.: WO2022/238834

PCT Pub. Date: Nov. 17, 2022

(65) Prior Publication Data

US 2024/0239534 A1 Jul. 18, 2024

(30) Foreign Application Priority Data

May 10, 2021 (IT) ..... 102021000011882
May 10, 2021 (IT) ..... 102021000011900

(51) Int. Cl.
*B65B 1/26* (2006.01)
*B65B 1/06* (2006.01)
(Continued)

(52) U.S. Cl.
CPC ..... *B65B 1/26* (2013.01); *B65B 1/06* (2013.01); *B65B 1/24* (2013.01); *B65B 1/32* (2013.01); *B65B 1/36* (2013.01); *B65B 9/10* (2013.01); *B65B 39/002* (2013.01); *B65B 39/04* (2013.01); *B65B 39/08* (2013.01); *B65B 2039/009* (2013.01)

(58) Field of Classification Search
CPC .... B65B 1/26; B65B 1/06; B65B 1/32; B65B 1/36; B65B 9/10; B65B 39/002; B65B 39/007; B65B 2039/009; B65B 39/08
USPC ..... 53/434
See application file for complete search history.

(56) References Cited

U.S. PATENT DOCUMENTS 3,518,809 A * 7/1970 Ott ..... B65B 31/06 53/511
3,879,917 A * 4/1975 Bassendale ..... B65B 39/04 53/469

(Continued)

*Primary Examiner* — Thomas M Wittenschlaeger
*Assistant Examiner* — Katie L Gerth

(57) ABSTRACT

A method for filling bags with bulk products includes providing a quantity of product for filling a bag, dispensing the quantity of product through a connection duct towards a filling station provided with designed to fill a bag with the product, and filling the bag with the quantity of product in the filling station. The quantity of product is intercepted and retained inside the connection duct, before arrival and filling at the filling station and is deaerated. The deaeration of the product is achieved at two separate steps. A filling apparatus and a bagging machine are configured to implement the filling method.

6 Claims, 8 Drawing Sheets

(51) Int. Cl.

| | |
|---|---|
| ***B65B 1/24*** | (2006.01) |
| ***B65B 1/32*** | (2006.01) |
| ***B65B 1/36*** | (2006.01) |
| ***B65B 9/10*** | (2006.01) |
| ***B65B 39/00*** | (2006.01) |
| ***B65B 39/04*** | (2006.01) |
| ***B65B 39/08*** | (2006.01) |

(56) References Cited

U.S. PATENT DOCUMENTS 4,074,507 A * 2/1978 Ruf ..... B65B 1/34 53/502
4,084,390 A * 4/1978 Schmachtel ..... B65B 63/028 53/511
4,287,703 A * 9/1981 Henle ..... B65B 43/54 53/449
4,753,306 A * 6/1988 Mosher ..... G01G 19/393 177/91
4,967,856 A * 11/1990 Kawanishi ..... G01G 13/244 177/1
5,832,700 A * 11/1998 Kammler ..... B65B 37/10 53/53
6,321,506 B1 * 11/2001 Rolland ..... A47J 31/404 53/53
9,873,532 B2 * 1/2018 Canestri ..... B65B 1/32
10,414,530 B2 * 9/2019 Murray ..... B65B 1/34
10,589,881 B2 * 3/2020 Vollenkemper ..... B65B 43/50
10,661,921 B2 * 5/2020 Wehling ..... B65B 1/22
11,801,950 B2 * 10/2023 Rapparini ..... B65B 1/26
2003/0089421 A1 * 5/2003 Hill ..... B65B 9/2028 141/83
2004/0182469 A1 * 9/2004 Concetti ..... B65B 1/34 53/502
2008/0257450 A1 * 10/2008 Combrink ..... B65B 1/22 141/270
2011/0079448 A1 * 4/2011 Almberg ..... G01G 13/34 177/116
2012/0180435 A1 * 7/2012 Stelluti ..... B65B 1/26 53/469
2014/0305542 A1 * 10/2014 Vollenkemper ..... B65B 1/06 141/69
2015/0183537 A1 * 7/2015 Canestri ..... B65B 1/36 53/436
2020/0130877 A1 * 4/2020 Concetti ..... B65B 43/30

* cited by examiner

METHOD AND APPARATUS FOR FILLING BAGS WITH A QUANTITY OF DEAERATED PRODUCT BY MEANS OF A DEAERATOR INSERTED IN THE PRODUCT

The present invention relates to a method and an apparatus for filling bags with a quantity of bulk material and to an automatic filling machine equipped with said apparatus.

It is known in the technical sector relating to the packaging of bulk material that there exists the need to arrange said material inside bags which must be filled with a metered quantity of material and then sealed.

It is also known that, for this purpose, automatic bag filling machines have been developed, an example of said machines consisting of so-called forming, filling and sealing (FFS) machines which are able to perform at high speed the cycle of forming the bag, filling the bag and final sealing of the bag mouth.

Said machines, which are known per se, comprise in particular a station for filling the bag with the material contained inside a hopper arranged at a height above the height of the bag mouth, in a position substantially coaxial with the bag itself. The quantity of product used for filling may be determined essentially using two main methods known as:

- the net-weight method, i.e. involving weighing of the product before it is introduced into the bag;
- the volumetric method, i.e. where a predefined volume of product is prepared independently of the measurement of its overall weight.

Machines of this type, which are known for example from EP 0,595,778 or EP 1,459,981 in the name of the same present Applicant, comprise a bag filling step which is performed by allowing the product to fall by means of gravity inside the bag which is filled with given quantities of product using one of the aforementioned metering methods.

Although performing its function, filling of the bag which is performed in a single step gives rise to a number of problems including the fact that products with a high quantity of intramolecular air, such as cements, finely ground calcium carbonates, powdered milk, starches, and the like have, when handled, the characteristic that their specific volume increases even by more than 50% compared to the settled product condition, owing to the air which is trapped between the molecules of the material.

These products, once bagged, if they have not been suitably treated, are highly unstable. Consequently, specific treatments are required in order to reduce the volume of the product inside the bag, in order to make them suitable for marketing.

In addition, it is also mentioned that a suitable compaction of the volume of bagged product results in a reduction of the material needed for packaging, thereby reducing the final cost and the impact on the environment.

In order to reduce the volume of these materials, auxiliary mechanisms such as vibrators and porous suction probes are used, these being designed to remove the air from the already bagged material and being installed on automatic filling machines, such as the abovementioned FFS machines for forming, filling and sealing the bag.

The deaeration and compaction steps described cause, however, an increase in the cycle times of the machine, with a consequent reduction of the productive capacity.

The compaction of the product inside the bag is moreover often unsatisfactory.

The technical problem which is therefore posed is that of solving or at least partially overcoming the said drawbacks of the prior art.

The technical problem which is posed in particular is that of developing a method for filling bags with a quantity of material, in particular bulk materials which increase their volume owing to the intramolecular air which they incorporate during filling, and of providing an automatic apparatus for implementing the method, said method and apparatus being designed to:

- ensure better deaeration of the product so as to obtain compact bags with a smaller volume; and/or
- obtain increased hourly production rates.

In connection with this problem, it is also required that this apparatus should have small dimensions, be easy and inexpensive to produce and assemble and be able to be easily installed on different types of bagging machines.

These results are obtained according to the present invention by a method for filling bags with a quantity of bulk material according to the features of claimed invention and by a filling apparatus according to claimed invention.

According to a first aspect, the invention therefore relates to a method and an apparatus for filling bags with a quantity of product, which involves: intercepting and retaining at least part of the product in a connection duct which connects a product dispensing container to a filling station, before arrival at the filling means of the filling station; and deaeration of the intercepted and retained product by means of deaeration means which are inserted into the product intercepted and retained in the connection duct.

The Applicant has surprisingly noticed that, owing to the fact at least a part (a semi-quantity) and preferably the whole quantity dispensed for filling a bag is deaerated before being dispensed to the filling means of one or more filling stations and from these discharged into the bag, it is possible to obtain better deaeration and compaction of the product inside the bag.

According to preferred embodiments of the method or the apparatus, the quantity of intercepted product retained inside a connection duct and deaerated by means of deaeration means before arrival at the filling means of the filling station is a metered quantity for entire filling of the bag in a single dispensing operation; in further embodiments, the quantity intercepted may be a metered quantity for partial filling of the bag.

The entire metered quantity of product for filling a bag may therefore be discharged into the bag in a single filling station.

According to a further preferred aspect, however, the predefined metered quantity of product is divided up into a first and at least one second semi-quantity of product, each dispensed through a respective connection duct connected to a respective filling station, so that each filling station fills the bag with the respective semi-quantity of product. The semi-quantities may be approximately equal.

According to preferred embodiments:

- at least the semi-quantity dispensed through the second connection duct connected to the second filling station and preferably the semi-quantity dispensed through each connection duct connected to a filling station arranged downstream of the first filling station is intercepted, retained and deaerated before arrival at the filling means of the respective filling station; and/or
- the semi-quantity dispensed through the connection duct connected to the first filling station is intercepted, retained and deaerated before arrival at the filling means of the respective filling station.

If a plurality of filling stations are used for filling a same bag it is advantageously possible:

- on the one hand to save time when filling the bag, for example by dispensing, intercepting and/or deaerating one or more semi-quantities of filling product simultaneously with the dispensing and/or the deaeration of one or more of the other semi-quantities of metered product, and/or simultaneously with the transportation of the bag between stations or with the filling or deaeration of the bag in another filling station;
- on the other hand (in addition or alternatively) it is possible to obtain a faster and better deaeration and compaction since the deaeration is performed on product quantities smaller than the total quantity metered for filling the bag.

In order to optimize the speed of the filling cycle the duct for connection to the first filling station may not have means for intercepting and deaerating the corresponding quantity of product to be dispensed.

In each filling station deaeration and/or vibration and compaction of the product contained in the bag may or may not be envisaged. According to further preferred embodiments of the method or of the apparatus, the entire metered quantity of product for filling a bag is intercepted, retained in one or more connection ducts and deaerated by means of deaeration means before arrival at the filling means of a respective filling station.

The method may envisage a further step of deaeration of the product inside the bag.

The quantity of product fed to the metering container may preferably be metered using the volumetric or net-weight method; in this latter case the container may be associated with weighing means, forming overall a hopper scale.

Preferably, the filling station may have filling means which comprise a respective hopper connected at the bottom to a bag-engaging filling device, preferably provided with valves rotating from a closed position to an open position and vice versa.

According to a preferred aspect of the invention the providing by means of metering of a quantity of product for filling a following bag may be performed at least partly at the same time as the deaeration of a metered quantity of product for filling the preceding bag inside the connection duct.

According to further preferred embodiments, dispensing of the metered quantity of product for filling a bag through the connection duct, with interception and retaining of the metered quantity inside the connection duct and/or deaeration by the means for deaerating the product retained inside the connection duct, may be performed at least partially at the same time as one or more of the following steps:

- filling a preceding bag with the product by means of the filling means of the associated filling station;
- deaeration and/or compaction of the product contained inside a preceding bag at the filling station;
- removal of a preceding full bag from the filling station;
- positioning of a following empty bag in the filling station, with coupling thereof to the filling means.

A further aspect of the present invention relates to a machine for filling bags with a metered quantity of bulk products comprising one or more apparatus for filling a bag according to the present invention, for example arranged in-line in a direction of feeding of the bags or in parallel perpendicularly to the direction of feeding of the bags.

Preferably, the machine according to the invention is a forming, filling and sealing (FFS) machine with bags formed in-line from a tubular material, or a filling machine with bags prefabricated and retrieved from a magazine associated with the said machine.

The entire metered quantity of product for filling a bag may be discharged into the bag in a single filling station.

In alternative embodiments, it is advantageously possible to use a plurality of filling stations of a filling machine for filling a same bag.

In each filling station, a deaeration and/or vibration and compaction of the product contained in the bag may or may not be performed.

The machine may also comprise a station for deaerating the bagged product downstream of the last filling station.

The features of the invention are particularly advantageous with products having a high quantity of intramolecular air.

BRIEF DESCRIPTION OF THE DRAWINGS

Further details may be obtained from the following description of non-limiting examples of embodiment of the subject of the present invention, provided with reference to the accompanying drawings, in which.

DETAILED DESCRIPTION OF THE INVENTION

Figure 1:
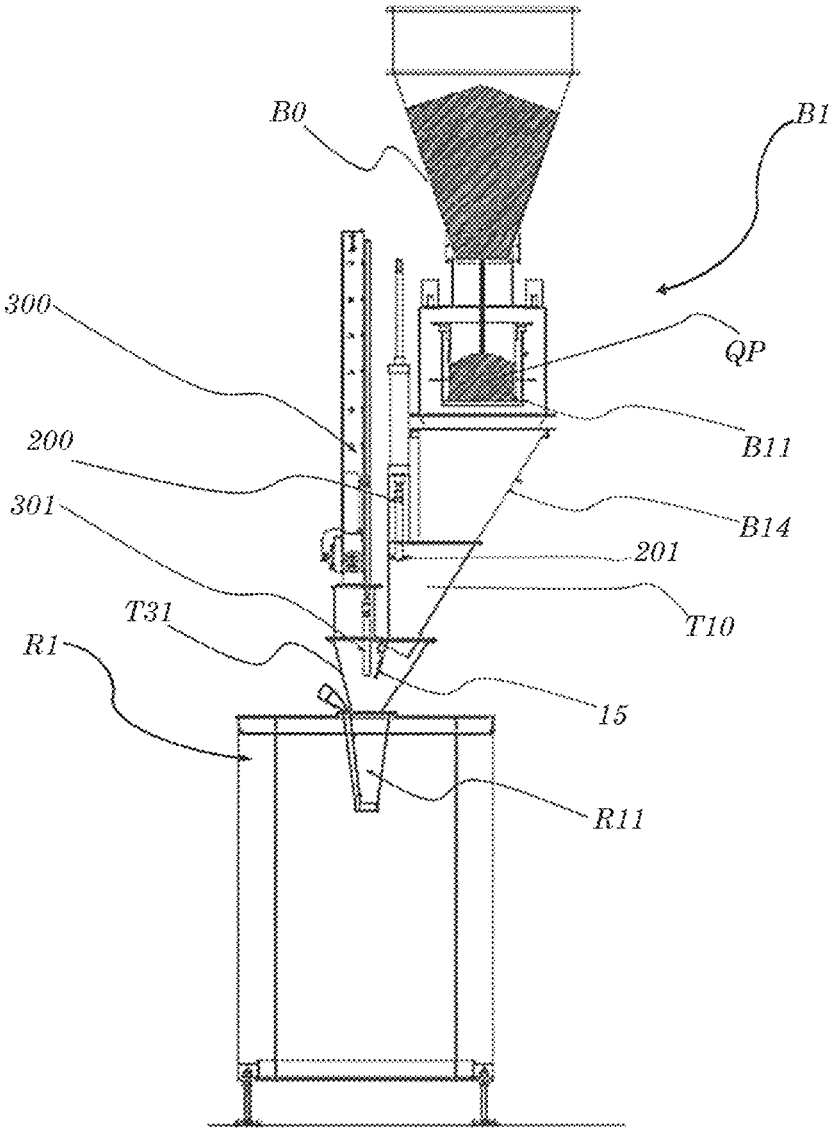
FIG. 1: is a schematic, partially transparent, side view of an example of embodiment of a filling apparatus according to the present invention.
Figure 2:
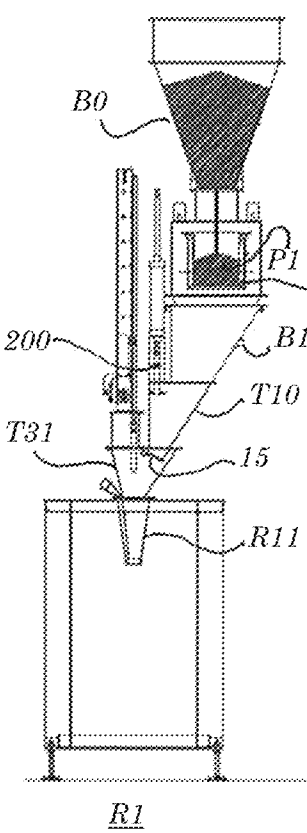
FIGS. 2-9: are schematic side views of an example of a working sequence of the apparatus according to FIG. 1.

As shown in FIG. 1, a first example of a filling apparatus according to the invention comprises a station R1 for filling a bag (not shown) with the material supplied from a metering apparatus B1, for example with net weight or volumetric metering, in the example of FIG. 1 schematically represented by a container B11 fed with a metered quantity QP of product for filling a bag, for example by means of a filling hopper B0. In particular, the container B11 may be for example provided with means for weighing the metered amount of product QP forming therefore an apparatus B1 for metering and dispensing a quantity QP of metered product.

According to conventional technology, the filling station R1 may comprise filling means for example comprising a hopper T31 for feeding the product to a bag-engaging unit R11 designed to be inserted inside the bag and to discharge the product inside it. The bag-engaging unit may be for example of the type arranged in the region of grippers (not shown) for retaining the bag and provided with valves rotating from a closed position into an open position and vice versa.

The container B11 is connected at the bottom to a respective duct B14 connected to the filling station R1 for supplying the product QP to the hopper T31 for feeding the associated filling means.

In the context of the present invention "connection duct" is understood as meaning any connecting structure or combination of connecting structures suitable for defining a travel path for the product, in particular by means of gravity, between the bodies which it connects together.

As shown in FIG. 1, in the example described the duct B14 receives the quantity of product from the container B11 in a top tubular section of the duct B14 and conveys it through a bottom section of the duct B14 which forms an intermediate hopper T10 arranged upstream of the hopper T31 of the filling means of the station R1 along the falling path of the product QP.

The bottom of the hopper-shaped section T10 of the duct B14 is provided with a shut-off valve 15 which can be controlled so as to close/open in order to retain/discharge the product inside/from the duct B14, said valve being an example of interception means designed to retain the product inside the duct B14 or allow it to pass through towards the filling station R1.

The hopper T10 also has, inserted inside it, a deaerator 220 which is designed to deaerate the product QP retained inside the duct B14 before it falls into the filling hopper T31 and then into the bag.

With this configuration, a metered quantity QP of product prepared inside the container B11 may be fed through the duct B14 towards the filling means T31,R11 of the filling station R1.

According to an advantageous aspect of the invention, at least one semi-quantity (namely at least a part) of the dispensed quantity QP, preferably the entire quantity QP of dispensed product for filling a bag is intercepted and retained by the shut-off valve 15 inside the duct B14 and deaerated by means of the deaerator 200, before being released by the valve 15 and conveyed to the filling means of the filling station R1 and discharged from the latter inside the bag S1.

The Applicant has in fact surprisingly noted that preliminary deaeration of the product, before it is bagged, is able to achieve a better deaeration and compaction thereof inside the bag.

The container B11 may for example be closed at the bottom by a partition which can be rotationally operated so as to open/close the respective volume and therefore dispense/intercept the product quantity QP.

As shown in FIG. 1, the hopper T10 may have a lateral extension with an upper opening inside which the deaerator 200 is inserted so as to deaerate the product retained inside the duct B14 before it is forwarded to the filling means of the station R1 and then introduced into the bag S1.

Figure 3:
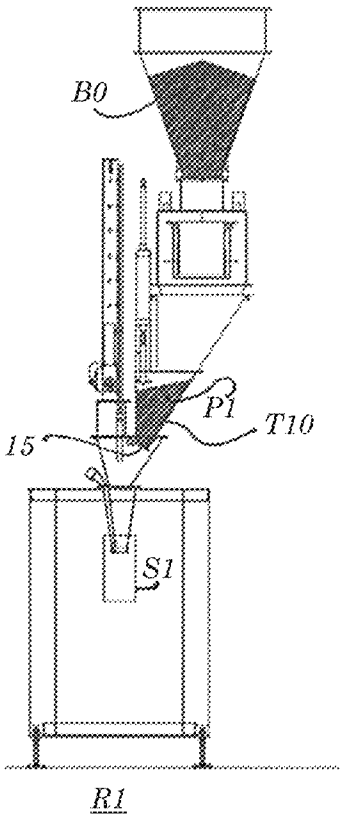
Figure 4:
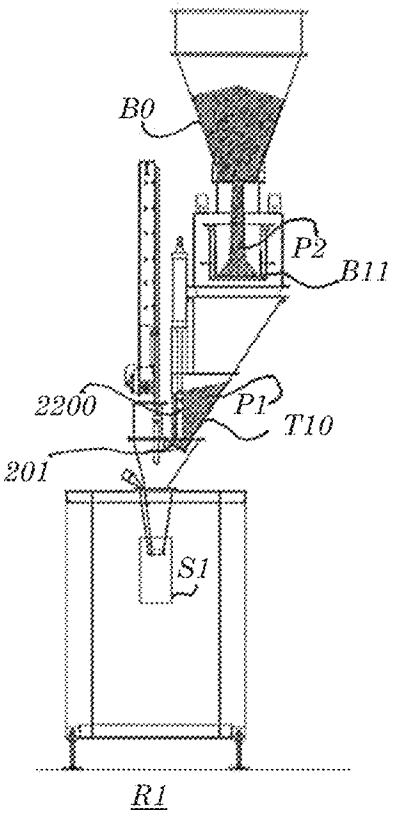

As shown in FIGS. 3 and 4, the deaerator 200 is movable inside the hopper T10 of the duct B14 between one position (in the example, raised position, FIG. 3), where it does not interfere with the transit of the product P1 inside the duct B14, and another position (lowered position, FIG. 4), where deaeration means 201 arranged at the bottom end of the deaerator 200 are inserted into the product P1 intercepted and retained inside the duct B14 by the shut-off valve 15. The deaeration means 201 are preferably in the form of a vacuum deaeration probe.

Advantageously, the deaerator 200 may therefore be kept in the raised non-interference position for allowing through-flow of the product and/or filling with those types of product which do not require deaeration.

Figures 6, 7, 8, 9:
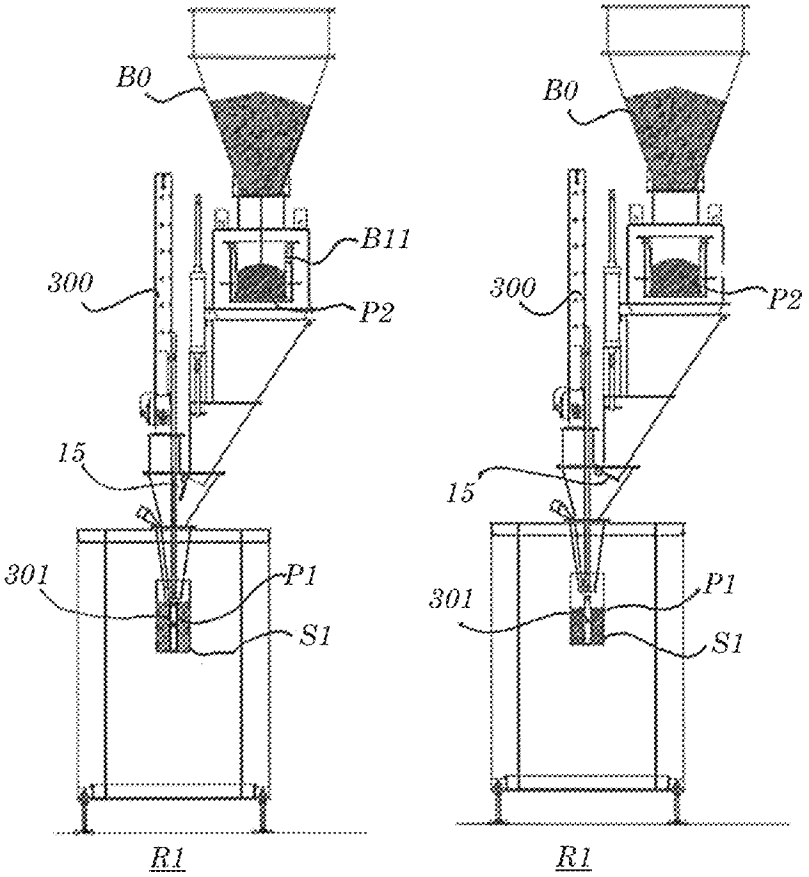

It is therefore clear how with the apparatus according to the invention it is possible advantageously to make use of the time required for filling the bag at the filling station and/or the time required for transportation of a bag between the stations of a filling machine in order to meter and/or deaerate the metered product for filling a following bag, intercepting it inside the duct B14, before feeding it to the filling station R1 and discharging it into the bag. With reference to FIGS. 1, 6 and 7, in preferred embodiments, the filling station R1 may be provided with a further deaerator 300, for example comprising a deaeration probe 301, which is designed to draw off the air so as to reduce the volume of the product already discharged inside the bag S1.

Figure 5:
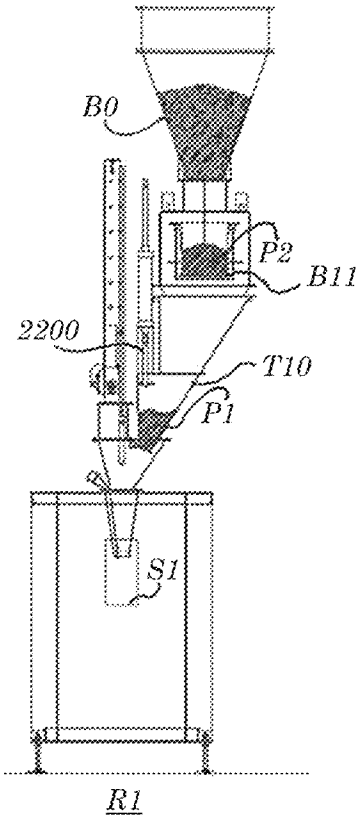

The deaerator 300 of the filling station R1 may be movable between one position (in the example raised position, FIG. 5), where it does not interfere with the transit and the positioning of the bag S1 in the filling station, and a position (in the example, lowered position, FIG. 7), in which the deaeration means 301 are inserted into the bag S1 for deaeration of the product P1.

As will become clear below, with this configuration it is possible to achieve both a further improved deaeration and compaction of the product P1 inside the bag and the further advantage of being able to make use of the deaeration time of the product P1 inside the bag S1 for the metering and/or the interception and deaeration of the product P2 for filling a following bag S2.

With reference to FIGS. 2-9, an example of the filling method according to the invention will now be described in the context of a preferred example of the operating cycle of the apparatus according to FIG. 1.

With this configuration of the apparatus, the filling method may comprise the following steps:

- metering (FIG. 2), in the example by means of weighing, the quantity of product P1 for filling a first bag S1;
- dispensing the metered quantity P1 (FIG. 3) from the metering apparatus B11 through the duct B14, as far as the bottom section in the form of an intermediate hopper T10, where it is retained on the bottom by the valve 15 arranged in the closed position;
- at the same time or beforehand, the first empty bag S1 is positioned in the filling station R1, connected to the bag-engaging filling means R11;
- starting the metering operation (FIG. 4) with metering of the quantity P2 of product for filling a second bag S2;
- moving the deaerator 200 from the raised position (FIG. 3) disengaged from the product P1 retained inside the hopper T10 into the lowered position (FIG. 4), where the end deaeration probe is immersed inside the product P1 retained by the valve 15 inside the connection hopper T10; the deaeration probe 201 is then activated for a programmed period of time for deaeration of the product P1.
- once the programmed time has ended, the probe 201 moves back upwards and the metered quantity P1 is now deaerated (FIG. 5).
- at the same time metering of the quantity P2 of product for filling a following bag S2 is performed;
- opening the valve 15 which allows the deaerated product P1 to fall towards the filling means and to be discharged therefrom into the bag S1 (FIG. 6);
- the deaerator 300 of the filling station is moved into the position inserted in the bag S1 and activated so as to deaerate the product P1 discharged inside the first bag S1 (FIGS. 6-7);
- once the product P1 has been discharged inside the bag, preferably during deaeration of the product P1 inside the first bag S1: the valve 15 is closed and the intermediate hopper T10 is ready to receive the second weighed quantity P2 of product; the quantity P2 is then discharged into the duct B14, reaching the hopper T10, on the bottom of which it is retained by the valve 15 arranged in the closed position (FIG. 8);

at the end of deaeration of the product P1 inside the bag S1 by the deaerator 300, the deaeration probe 301 of the filing station R1 is raised, releasing the first filled bag S1-P1 (FIG. 8);

after the metered quantity P2 for filling the second bag has been discharged inside the duct B14, metering of a next (third) quantity of product P3 for filling a further bag is started (FIG. 9);

the deaerator 200 is moved from the raised position disengaged from the product P2 retained inside the hopper T10 into the lowered position, where the end deaeration probe 201 is immersed in the product P2 retained by the valve 15 inside the connection duct T10; the deaeration probe 210 is then activated for a programmed time for deaeration of the product P2;

the full bag S1-P1 has in the meantime been removed from the filling station R1 and a new empty bag S2 is positioned in the filling station R1, being connected to the bag-engaging filling means R11 (FIG. 9);

once the programmed time has ended, the probe 201 moves back upwards and the metered quantity P2 of product is deaerated;

the valve 15 is opened, allowing the deaerated product P2 to fall towards the filling means R11 and to be discharged therefrom into the bag S2;

the following metering operation P3 is completed and the cycle is repeated for the following bags and metered quantities of product.

It is therefore clear how the filling method according to the invention is able to achieve optimum deaeration of the product by making use also of what is normally the idle time required for transporting and positioning a bag as well as metering the product and where necessary deaerating the product, in order to perform one or more operations involving metering, interception and preliminary deaeration of the product for filling a following bag. This therefore improves both the deaeration and the productivity.

Figure 10:
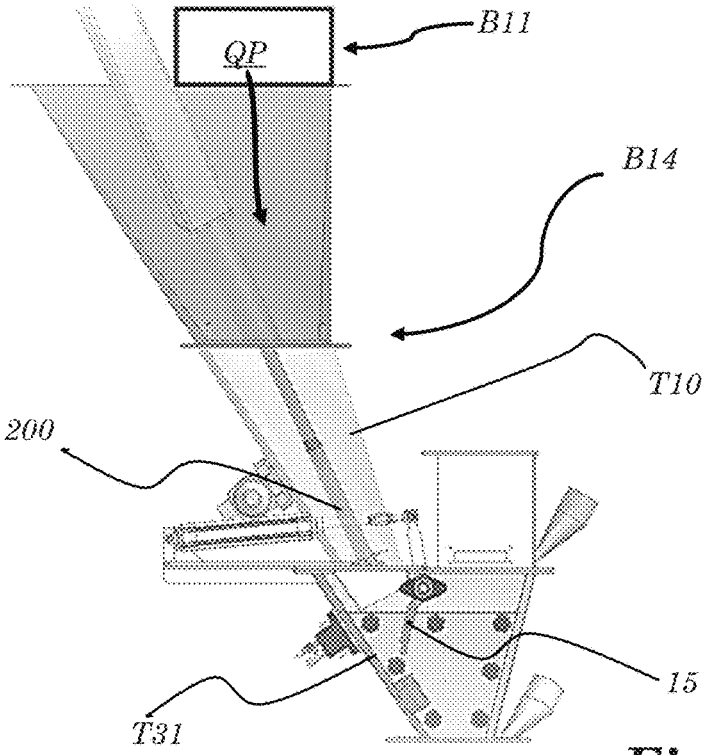
FIG. 10: is a partially transparent front view of a variation of an example of embodiment of a filling apparatus according to the present invention, with a single filling station.

FIG. 10 shows a variation of an example of embodiment of the filling apparatus with a single station R1 for filling the bag, which differs from the embodiment of FIG. 10 in that the deaerator 200 is arranged laterally with respect to the connection duct B14 and is inserted inclined at an angle with respect to the vertical inside the bottom hopper T10 of the connection duct.

As will become clearer below in the continuation, this inclined arrangement may be advantageous for facilitating the movement of the deaerator 200 and/or for use in apparatus or machines with multiple filling stations arranged side-by-side.

According to one advantageous aspect, one or more filling apparatus according to the present invention may be incorporated in a bag filling machine, for example arranged in-line or in parallel with respect to a direction of feeding of the bags. A filling machine, in particular of the FFS type, may for example comprise:

a station for forming the bag from a tubular product unwound from a reel;

one or more filling stations according to the present invention, each with at least one station R1 for filling the bag with the material supplied from a metering apparatus B10;

optionally, a station for final deaeration of the product contained inside the filled bag and arranged downstream of the last filling station;

a station for sealing the mouth of the filled bag.

Conveying of the bag from one station to the other is preferably performed by transportation means, for example in the form of a slide provided with means for gripping the bag, while conveying of the bag out of the machine may be performed by extraction means, for example comprising a motor-driven belt or rollerway.

Each filling station R1 may also be provided with pairs of fixed grippers of suitable dimensions for gripping the top part of the bag.

The filling stations provided by way of example may also be equipped with vibrating devices arranged underneath the bag in order to compact the product before the bag is sealed.

It is therefore clear how the method, the apparatus and the machine according to the invention allow the filling of bags also with products which increase their own volume owing to the intramolecular air using a continuous cycle within automatic bagging machines, for example of the FFS type or the like, with a substantial reduction in the idle time and a consequent increased hourly productivity compared to similar machines of the prior art; this is due to the fact that the deaeration of the product inside the discharge hopper may be advantageously made use of and carried out simultaneously with the transfer of the bag from the filling station to the following mouth closing means, which with the conventional systems are not used.

In addition, the discharging of the product into the connection duct inside which it is retained and deaerated results in initial consolidation of the product. Discharging of the deaerated product into the bag and subsequent deaeration result in further consolidation and compaction. The compaction of the bagged product is therefore improved.

The filling of each bag with a quantity of already deaerated product may also allow much faster deaeration and compaction during filling since the volumes of product to be treated in the filled bag, and therefore the retained air, are smaller.

The deaeration in a connection duct between the metering system and a respective filling station may advantageously take place during idle time previously not made use of in known filling machines; for example it possible to make use of the time during which the product is at a standstill waiting for the bag to arrive at the bag filling station and/or the time required for deaeration of the product inside the previously filled bag and/or the time required for metering the metering the metered quantity of product for filling the next bag.

The filling apparatus according to the invention is therefore able to:

obtain a product which is better compacted, with a greater time for deaeration, without increasing the overall cycle time of the bagging machine; and/or obtain bags which are more compact owing to greater deaeration.

Although the metered quantity of product QP has been described with reference to the quantity necessary for filling a bag, it is understood that this metered quantity could also be a quantity for partial filling of the bag; the filling of each bag with a partial quantity may allow deaeration and compaction during filling faster than the similar operations performed on a bag filled with the entire volume of the product, since the product volumes to be treated at each metering, deaeration and discharging operation, and hence the treated air, are smaller.

Figure 11:
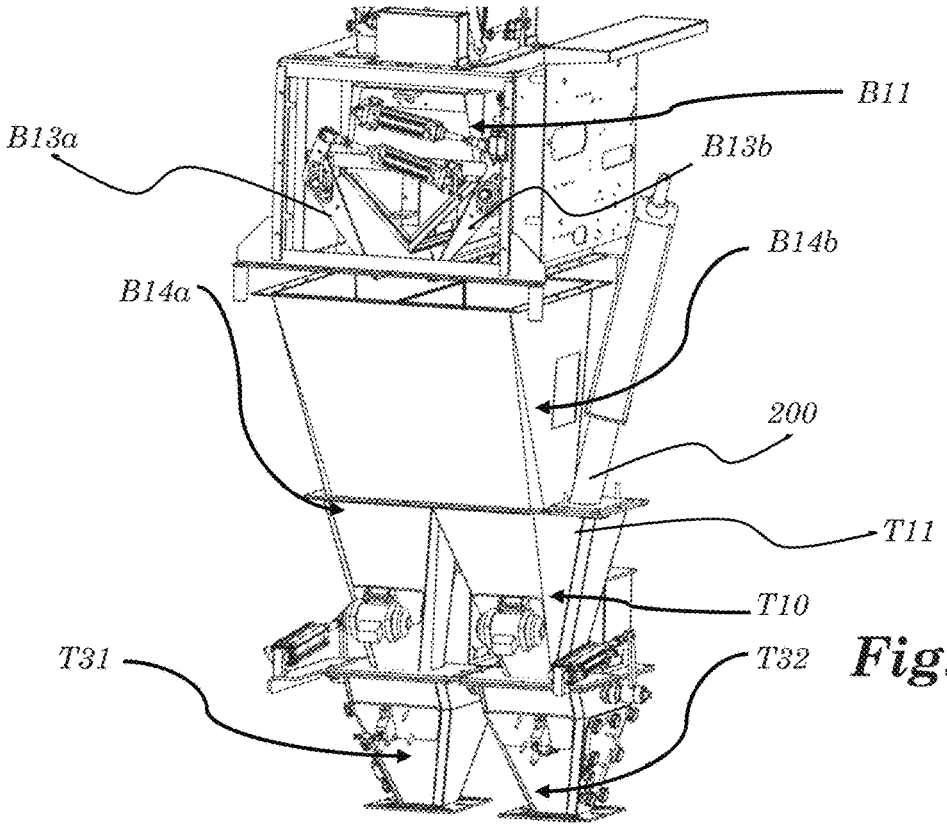
FIG. 11: is a perspective side view of an example of embodiment of the filling apparatus according to the present invention, with two filling stations.

With reference to FIG. 11, a second embodiment of the filling apparatus according to the present invention comprises:

a first station R1 for filling the bag; and at least one second station R2 for filling the bag.

In greater detail, in the same way as described with reference to FIGS. 1 and 10, each filling station R1,R2 comprises bag filling means, in the example schematically indicated by a respective hopper T31,T32, to the bottom opening of which, during use, there will be connected a bag-engaging device for discharging the product into the bag, for example of the type arranged at the fixed grippers and provided with valves rotating from a closed position into an open position and vice versa.

Each filling station R1,R2 is connected at the top to a container B11 fed with a metered quantity QP of product for filling a bag; in particular, the container may be for example provided with means for weighing the metered amount of product, forming therefore a metering and dispensing apparatus.

The container B11 is divided up (FIGS. 13-17), preferably by a vertical dividing wall B12, so as to form two independent half-volumes B11*a* and B11*b* with a capacity preferably substantially equal to half the total capacity of the container B11; each half-volume is closed at the bottom by a respective partition B13*a*,B13*b* which can be rotationally operated so as to open/close the respective half-volume and therefore dispense/intercept the respective semi-quantity of product Q1P1,Q2P1 contained inside it.

Each half-volume B11*a*,B11*b* is connected at the bottom to a respective duct B14*a*,B14*b* connected to a respective filling station R1;R2; in particular to one hopper of the two hoppers T31,T32 for feeding the filling means, so that each hopper is preferably fed by a duct B14*a* or B14*b* leading from the container B11.

In the example shown, the second duct B14*b* which receives the semi-quantity Q2P1 of the second half-volume B11*b* forms, in a bottom section thereof, a hopper T10 arranged upstream of the hopper T32 for feeding the filling means of the second station, along the falling path of the product Q2P1.

On the bottom of the hopper T10 there is a shut-off valve 15, which can be operated so as to close and open in order to retain/discharge the product inside/from the duct B14*b*.

As shown, the hopper T10 has a lateral extension T11 (FIG. 12*a*) with an upper opening inside which a deaerator 220 is inserted so as to deaerate the product Q2P1 retained inside the second duct B14*b* before it is forwarded to the filling means of the second station R2 and then into the bag 1.

Figure 12A:
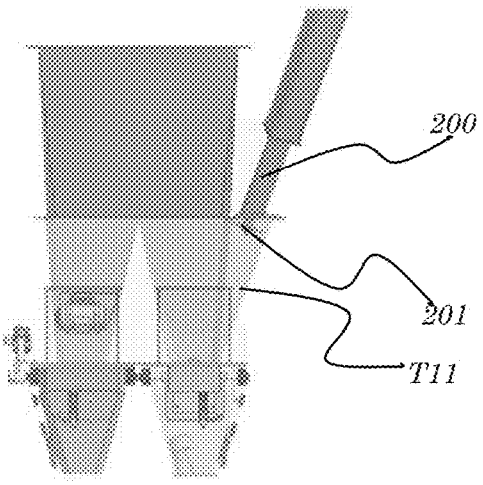
FIGS. 12*a*, 12*b*: are a partially transparent, partial side view of the filling apparatus according to FIG. 4, with deaerator respectively raised and lowered.
Figure 12B:
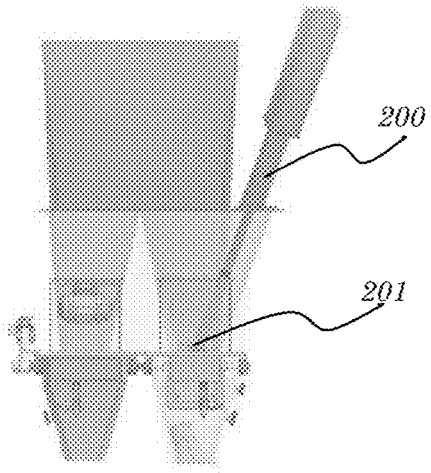

As shown in FIGS. 12*a*, 12*b* the deaerator 200 is movable inside the hopper T10 of the duct B14*b* between one position (in the example, raised position. FIG. 12*a*), where it does not interfere with the transit of the product Q2P1 inside the respective duct B14*b*, and another position (in the example, lowered position, FIG. 12*b*), where the deaeration means 201 arranged at the bottom end of the deaerator 200 are inserted inside the product intercepted and retained inside the duct of the shut-off valve 15.

Advantageously, the deaerator may therefore be kept in the raised position for filling with a product which does not require deaeration or in order to facilitate the transit of the product to be deaerated inside the duct.

Although not shown, one or more of the filling stations R1,R2 may be provided with air suction probes for reducing the volume of the product inside the bag and/or vibration means may be provided for compacting the product inside the bag.

Therefore in the apparatus according to FIGS. 11 and 12 it is not envisaged intercepting and deaerating the product (Q1P1) dispensed from the first half-volume B11*a* to the first filling station R1.

In embodiments with multiple filling stations R1,R2 it may in fact be preferred that there should be present only means for intercepting and means for deaerating the semi-quantities of each half-volume connected to a filling station arranged downstream of the first filling station R1, arranged between the half-volume and the filling means of the respective station. In this way it is possible advantageously to make use of the filling time at the first station and the transportation time between stations in order to deaerate the product before feeding it to the respective following downstream filling stations.

With reference to FIGS. 13, 14-17, the operation of the apparatus according to FIG. 11 as well as a further example of the filling method according to the invention will now be described in connection with a preferred example of the filling machine, purely by way of example of the FFS type, equipped with the apparatus according to the invention.

Figure 13:
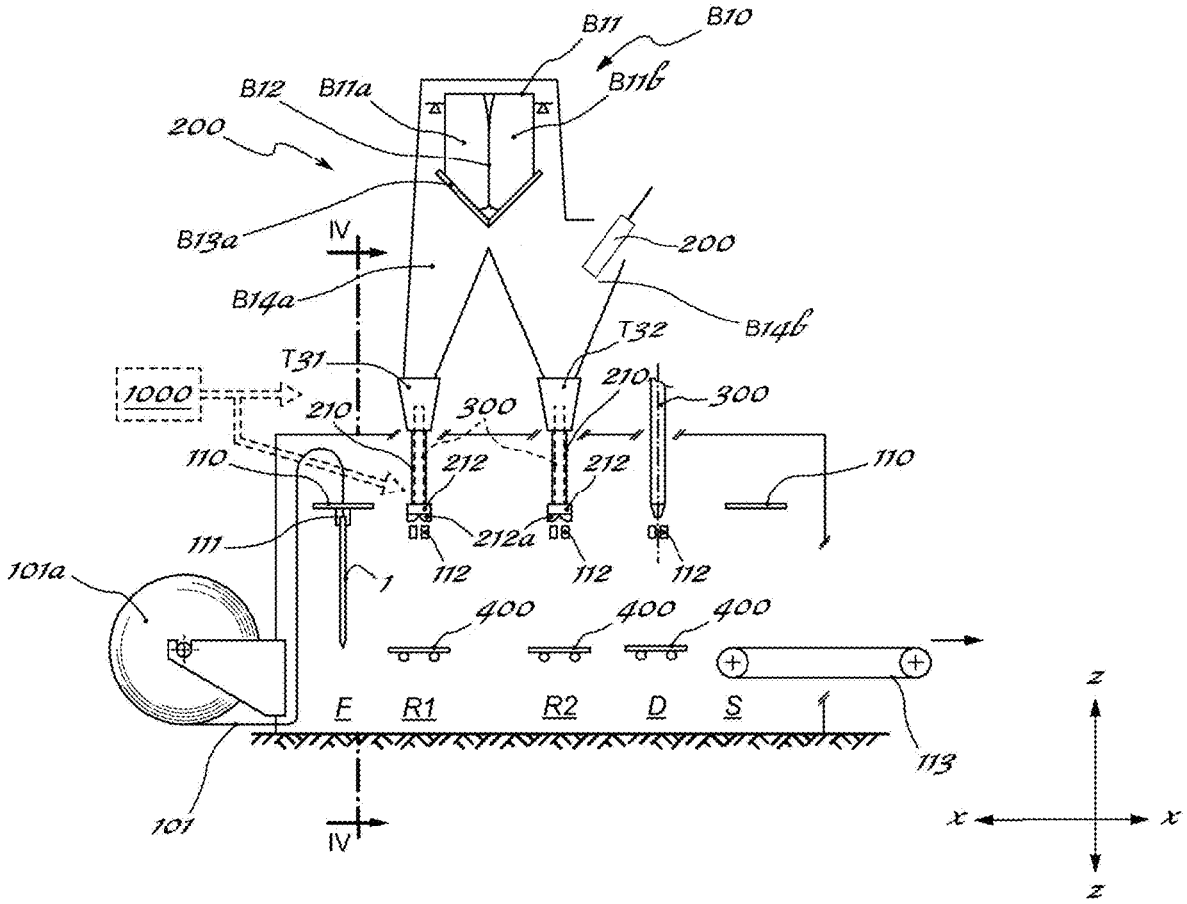
FIG. 13: is a schematic side view of a forming/filling machine with filling apparatus according to the present invention.
Figure 14:
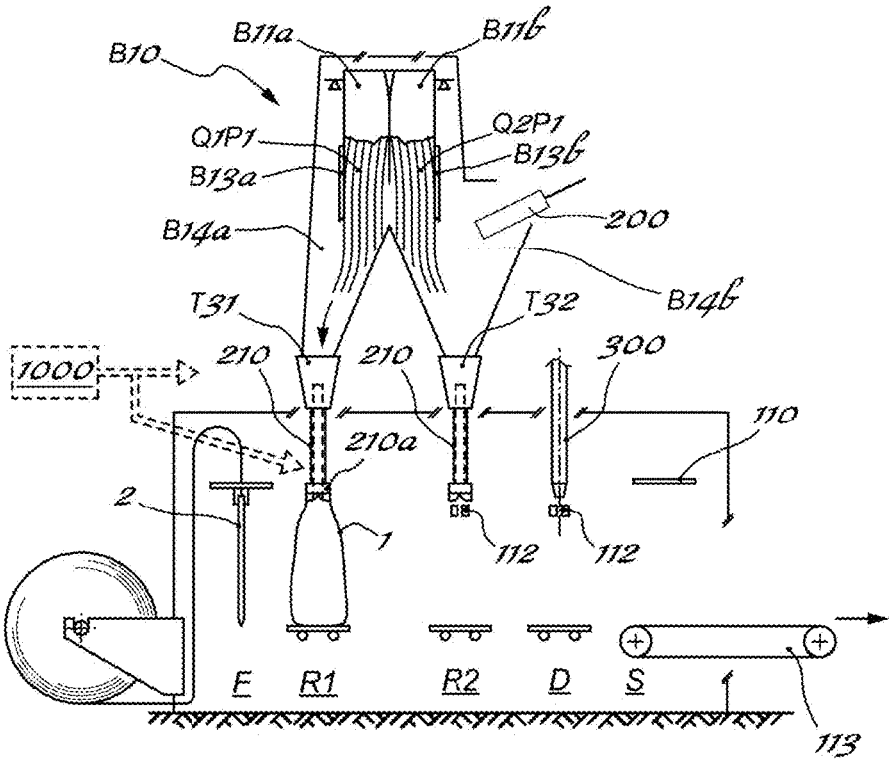
FIGS. 14-18: are schematic side views of an example of a working sequence of the machine according to FIG. 14.

With reference to FIG. 13 and assuming solely for easier description and without any limiting meaning a set of three reference axes respectively in a longitudinal direction X-X, corresponding to the direction of feeding of the bag inside the machine; transverse direction Y-Y perpendicular to the preceding direction and corresponding to the width of the machine; and vertical direction Z-Z perpendicular to the other two directions; as well as a rear side corresponding to the side for entry of the tubular product used to form a bag and a front side corresponding to the side for exit of the filled bag, an example of an FFS machine with apparatus according to the invention substantially comprises:

a station F for forming the bag 1 from a tubular product 101 unwound from a reel 101*a;* an apparatus of the present invention with

- a first station R1 for filling the bag with the material supplied from a metering apparatus B10;
- a second station R2 for filling the bag with the material supplied from the metering apparatus B10;
- a station D for final deaeration of the product contained inside the filled bag and arranged downstream of the second filling station R2;
- a station S for sealing the mouth 1*a* of the bag 1.

Conveying of the bag from one station to the other is preferably performed by means of a slide provided with means for gripping the bag, while conveying of the machine out of the machine may be performed by means of motor-driven belt or rollerway 113.

Each filling station R1,R2 and deaeration station D is also provided with pairs of fixed grippers 12 of suitable dimensions for gripping the top part of the bag.

In detail, each filling station R1,R2 comprises a respective hopper T31,T32 which has, connected to the bottom opening thereof, a tube 210 for connection to the bag-engaging device 210*a* arranged in the vicinity of the fixed grippers 112 and provided with valves 210*b* rotating from a closed position to an open position, and vice versa.

As described above, each filling hopper T31,T32 is connected at the top by means of a respective duct B14*a*, B14*b* to the metering and dispensing system B10, the container B11 of which is divided up into two halves B11*a*, B11*b*, respectively, preferably by a vertical dividing wall B12, so as to form two independent half-volumes with a capacity preferably substantially equal to half the total capacity of the container, so that the metered quantity QP of product is divided up into two semi-quantities Q1P1 and Q2P1; each half-volume is closed at the bottom by a respective partition B13*a*,B13*b* which can be operated into the open/closed position in order to dispense/intercept the semi-quantity of product Q1P1,Q2P1 contained inside it.

The second duct B14*b* receives the second semi-quantity Q2P1 through the intermediate hopper T10 formed in the second duct upstream of the second filling station R2; the shut-off valve 15 is provided on the bottom of the hopper T10 and the deaerator 220 is movable inside the hopper T10 so as to deaerate the product Q2P1 before it falls into the hopper T32 and then into the bag 1.

As shown, air suction probes 300 for reducing the volume of the product inside the bag may be provided in the filling stations R1,R2 and the deaeration station D.

The three stations R1, R2, D shown by way of example are also provided with vibrating devices 400 arranged below the bag in order to compact the product before sealing the bag.

Programming and control means 1000 are provided for automated execution of the various operating steps.

Figure 15:
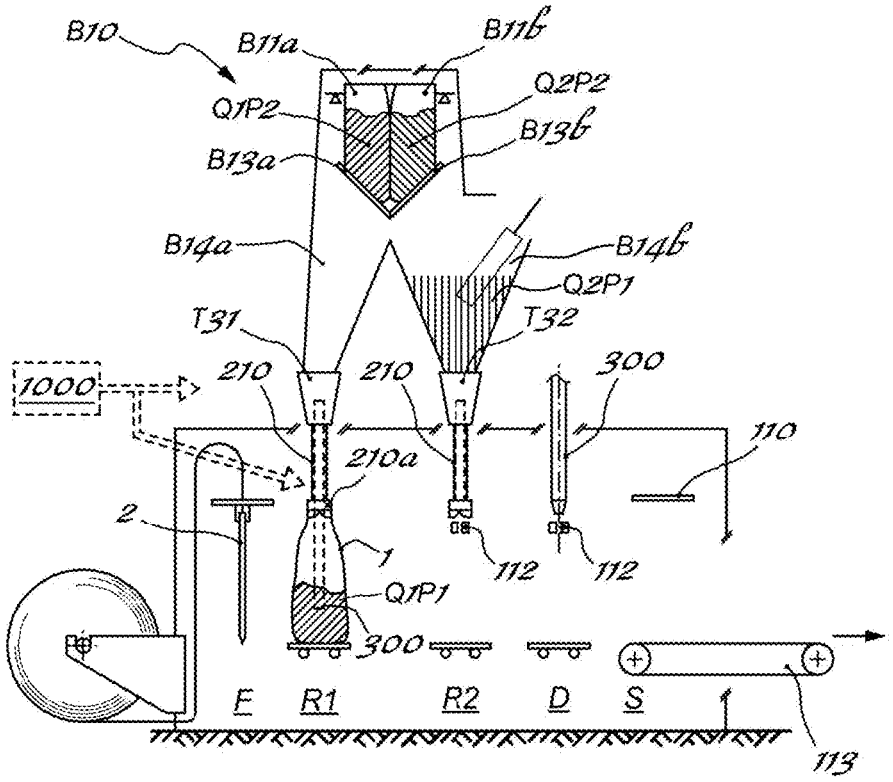
Figure 16:
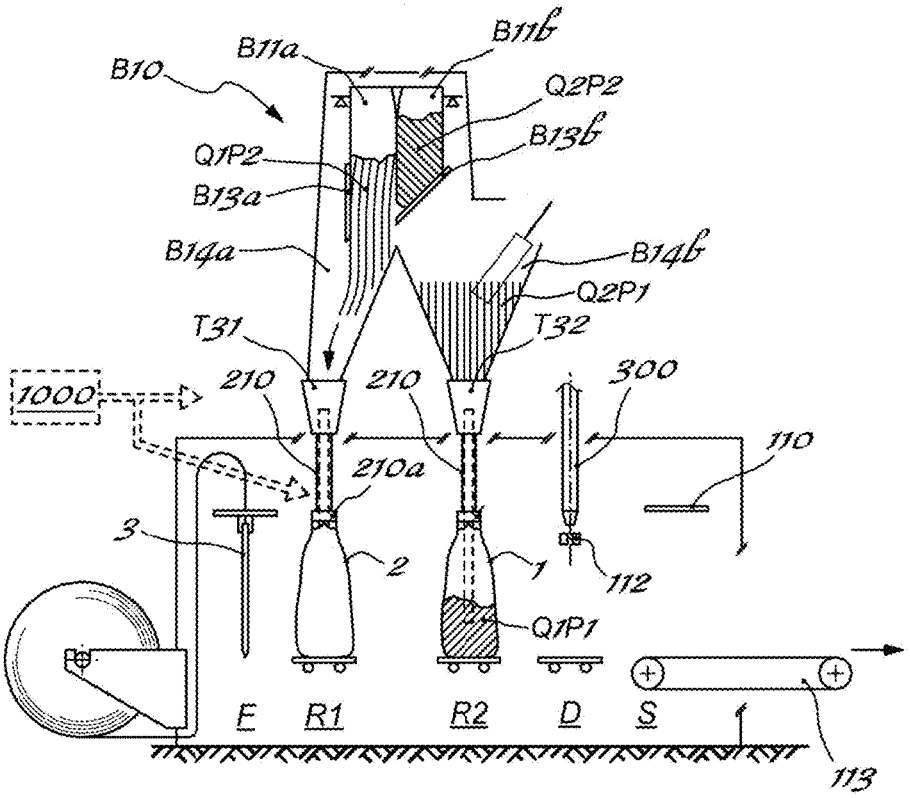
Figure 17:
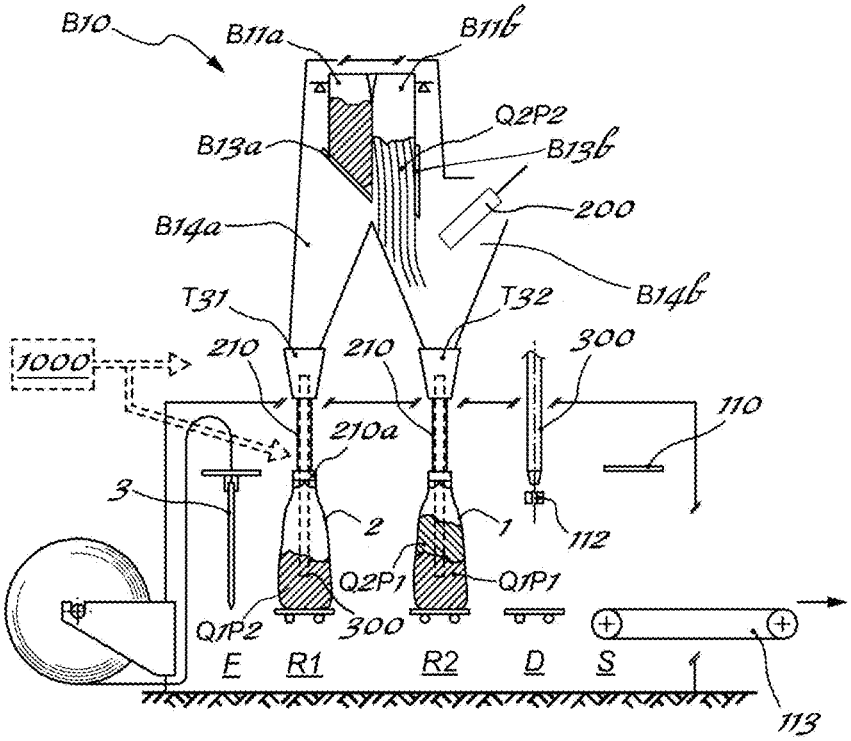
Figure 18:
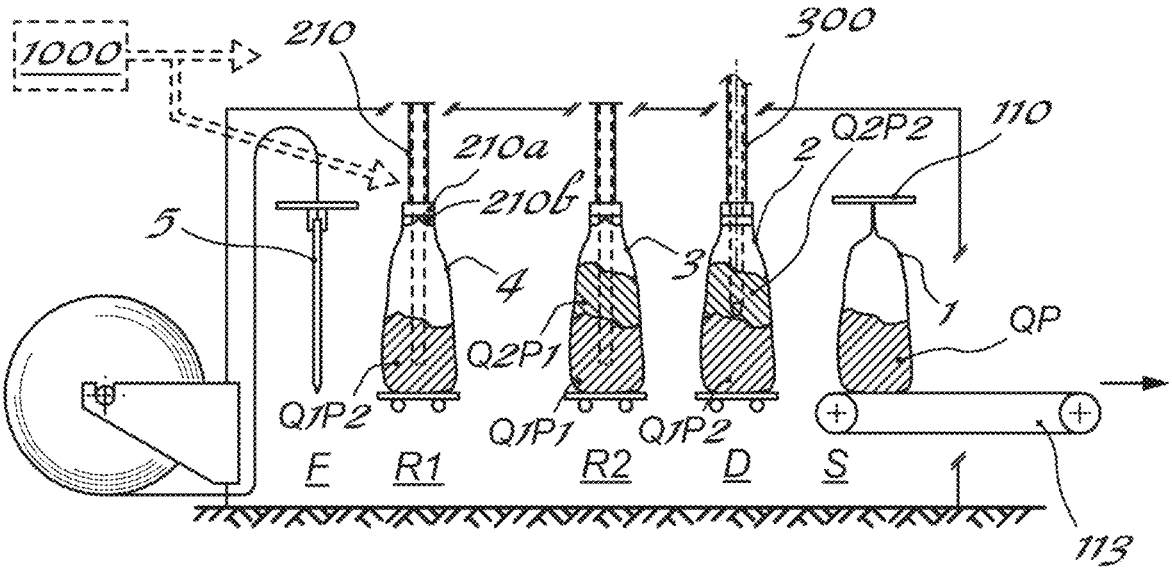

With the apparatus configurations described above the bag packaging machine operates in accordance with the steps of the following method (FIGS. 14-18):

a) the programmed metered quantity of the product P1 is prepared in the container B11 (FIG. 14) by dividing the total quantity QP into two semi-quantities Q1P1 and Q2P1 equal to approximately half the total quantity, subdividing them between the two volumes B11*a* and B11*b* of the container B11 of the metering system B10;

b) a first bag 1 is fed to the first filling station R1 where it is connected to the filling apparatus;

c) filling of the bag 1 with the quantity of product Q1P1 of the first half-volume B11*a* of the metering system B10 is started, said product, following opening (FIG. 14) of the dividing wall B13*a*, falling through the first duct B14*a* into the hopper T31 and from here into the bag 1 (FIG. 15);

d) the partition B13*a* of the second half-volume B11*b* of the metering system B10 is opened (FIG. 14) and the second half Q2P1 of the product is allowed to fall into the intermediate hopper T10 of the second duct B14*a*, where it is intercepted and retained by the shut-off valve (FIG. 15);

e) the deaerator 200 is lowered into the hopper T10 (FIG. 15) as far as the position where it is inserted inside the second semi-quantity Q2P1 of product and the deaerating means 201 are activated so as to deaerate the product Q2P1 before it falls from the duct B14*b* towards the hopper T32 of the second filling station;

f) in the meantime once the bag 1 is filled with the first semi-quantity of product Q1P1 and optionally the first semi-quantity is deaerated by means of the probe 300 of the first filling station R1 (FIG. 16), the bag 1 is fed forwards to the second filling station R2 (FIG. 17);

g) in the meantime (FIG. 16), a new quantity of product QP is fed to the metering system B10 for a further metering and dispensing cycle and a second bag 2 is fed to the first filling station R1;

h) optionally, the deaerator 200 is moved to the raised position of non-interference with the transit of the product inside the hopper T10;

i) the shut-off valve of the hopper T10 is opened so as to discharge (FIG. 17) the second semi-quantity Q2P1 of product into the bag 1 through the filling means 210*a* and complete the filing thereof;

j) the bag 2 is in the meantime filled with the first half Q1P2 of the product P2 supplied from the first half-volume B11*a* of the metering system B10;

k) the shut-off valve 15 is closed again;

l) the first bag 1 advances towards the deaeration and vibration station D in order to complete the reduction in volume and compaction of the product inside the bag, while the bag 2 advances towards the filling station R2;

m) the second half Q2P2 of product P2 supplied from the second half-volume B11*b* is discharged and intercepted inside the hopper T10 of the second duct B14*b* inside which it is deaerated during the waiting time for arrival of the bag 2 at the second filling station R2;

n) the second bag 2 is positioned in the second filling station R2 where it is filled with the semi-quantity of product Q2P2;

o) the bag 1 proceeds to the sealing station S and the bag 2 proceeds to the deaeration station D;

p) the bags 1 and 2 complete (FIG. 18) their sealing cycle S and exit cycle 113, while the following bags 3, 4 and 5 are being respectively filled at the second and first station R2,R1 and being fed to the first station.

If required, deaeration may be completed both in the first and/or second station R1, R2 and in the deaeration and final compaction station D before the mouth 1*a* of the bag is sealed, by means of the deaeration system 300 and vibration system 400.

It is therefore clear how the method, the apparatus with multiple filling stations and the machine described are able to perform the filling of bags containing products which increase their volume owing to the intramolecular air, with a substantial reduction in the idle time and consequent increase in the hourly productivity compared to similar machines of the prior art since:

the filling of each bag with half the quantity at a time allows deaeration and compaction during filling to be performed much faster than the similar operations carried out on a bag filled with the entire volume of product, since the volumes of product to be treated at each station, and therefore the retained air, are smaller;

the partial deaeration in one or more connection ducts between the metering system and a respective filling station takes place in an idle time during which the product is at a standstill waiting for the bag to arrive from the preceding bag filling station.

By making use of this time it is also possible to:

obtain a product which is better compacted, with a greater time for deaeration, without increasing the overall cycle time of the machine; and/or obtain bags which are more compact owing to greater deaeration.

The machine also results in smaller overall dimensions since only one metering system is present.

The filling apparatus could also have more than two, in particular for example three filling stations which are designed to fill a same bag with respective semi-quantities of metered product. The aforementioned technical advantages increase proportionally with the increase in the number of filling stations, but this advantage must be weighed up against the increase in the complexity and size of the machine and the transportation time between the successive stations so that it is considered that, preferably, the apparatus should not have more than four filling stations for the same bag.

Although the apparatus and the FFS machine have been described in connection with metering of the product performed using the net-weight method, it is envisaged that the metering and dispensing system may be of any known type, for example with metering of the product using the volumetric method.

In this case, since weighing is not necessary, the quantity of product introduced into the container B11 or into the respective half-volumes B11 may for example be determined with precision upstream thereof, on the basis of suitable devices.

All the embodiments are also preferably provided with programming and control means, such as an electronic unit which controls suitable actuators, for automated execution of the various operating steps.

It is also envisaged that the method and the filling apparatus according to the present invention may be applied also to filling machines in which the bag is already formed and stacked in a magazine from where it is removed and conveyed directly to the mouth of the bag-engaging device of the filling station R1 from where the already described cycle starts.

Although described in connection with a number of embodiments and a number of preferred examples of implementation of the invention, it is understood that the scope of protection of the present patent is determined solely by the claims below.

The invention claimed is:

1. A method for filling bags with bulk products, comprising the following steps:

providing a metered quantity of product for filling a bag;

dispensing the quantity of product through one or more connection ducts towards one or more filling stations each provided with filling means designed to fill the bag with the product;

intercepting and retaining at least part of the quantity of dispensed product inside at least one connection duct of the one or more connection ducts, before arrival at the filling means of a respective filling station of the one or more filling stations;

deaerating the quantity of intercepted and retained product by deaeration means;

filling the bag with the dispensed quantity of product, in the one or more filling stations, wherein a first step of deaeration of the quantity of intercepted and retained product is performed by a first deaeration means inserted into the product intercepted and retained in the at least one connection duct, wherein a second step of deaeration of the product contained inside the bag is performed by a second deaeration means at at least one of the one or more of the filling stations, and wherein the predefined metered quantity of product is divided up into a first semi-quantity of product and at least one second semi-quantity of product, each dispensed via a respective one of said one or more connection ducts connected to a respective one of a first filling station and at least one second filling station arranged downstream of the first filling station in a direction of feeding of the bag, wherein each filling station of said first and at least one second filling stations fills the bag with a respective semi-quantity of product;

transporting a bag to the first filling station;

dispensing the first semi-quantity of product towards the first filling station and filling the bag with the first semi-quantity of product;

dispensing a second semi-quantity of product of the at least one second semi-quantity of product towards the second filling station;

intercepting and retaining the second semi-quantity of product before its arrival at the filling means of the second filling station;

deaerating the second semi-quantity of retained product;

transporting the bag to the second filling station;

discharging the second semi-quantity of deaerated product into the bag by means of the filling means of the second filling station;

deaerating the product contained inside the bag of the second filling station, wherein one or more of the steps of dispensing, intercepting and deaerating the second semi-quantity of product is performed simultaneously with one or more of the steps of: dispensing the first semi-quantity of product towards the first filling station, filling the bag in the first filling station and transporting the bag to the second filling station; and wherein semi-quantities of the first semi-quantity and the at least one second semi-quantity are approximately equal, the second semi-quantity dispensed via a second duct connected to the second filling station is intercepted, retained and deaerated before arrival at the filling means of the second filling station, and the first semi-quantity dispensed via the connection duct connected to the first filling station is intercepted, retained and deaerated before arrival at the filling means of the respective filling station.

2. The method according to claim 1, wherein the interception of the product is performed by a respective valve for closing a respective connection duct which is movable into a closed or open position for intercepting or discharging the product; or intercepting, retaining and deaerating the product is performed in a lower section of the respective duct configured as an intermediate hopper.

3. The method according to claim 1, wherein the deaeration in the at least one connection duct is performed by the first deaeration means movable from a position of non-interference with the passage of the product inside the at least one connection duct into a position for insertion in the product intercepted and retained inside the at least one connection duct by a deaerator movable downwards or upwards inside an intermediate hopper.

4. The method according to claim 1, further comprising at least one of:

a step of metering the quantity of product to be supplied using a volumetric or net-weight metering method;

a step of sealing the mouth of the filled bag downstream of the one or more filling stations;

a step of deaeration and/or compaction of the product contained inside the filled bag, downstream of the one or more filling stations and before a step of sealing the mouth of the bag; and a step of forming the bags to be filled from a tubular material and transporting the bags to the one or more filling stations in a forming, filling and sealing machine, or of taking the bags to be filled from a magazine of prefabricated bags associated with a filling machine and transporting the bags to the one or more filling stations.

5. The method according to claim 1, wherein deaeration and compaction of the product contained inside the bag at the one or more filling stations is at least one of:

a) performed at least partly at the same time as one or more of the following operations:

providing a quantity of product for filling a following bag;

dispensing the quantity of product supplied for filling a following bag through the at least one connection duct towards the filling station, with interception and retaining of the quantity of product inside the at least one connection duct;

deaerating, by means of the first deaeration means, of the product for filling a following bag intercepted and retained inside the at least one connection duct; and b) performed by a deaerator with the second deaeration means movable between a position for non-interference with the transit and the positioning of a bag inside the filling station and a position in which the second deaeration means are inserted inside the bag for deaeration of the product contained in the bag.

6. The method according to claim 1, wherein the metered quantity of product supplied for filling the bag is metered inside a container, wherein the container is associated with weighing means, forming overall a scale device, and wherein the container is divided up into a first half-volume and at least one second half-volume which are independent, each half-volume being able to contain a respective semi-quantity of product and being connected at the bottom to a respective station for filling the bag to be filled, by means of a respective connection duct.

* * * * *